US007731598B1

(12) United States Patent
Kim

(10) Patent No.: US 7,731,598 B1
(45) Date of Patent: Jun. 8, 2010

(54) GOLF CLUB WITH SLOPE INDICATOR

(76) Inventor: Seok Ki Kim, 10 Floor, Universal House, 229-230 Gloucester Road, Wanchai, Hong Kong (HK)

( * ) Notice: Subject to any disclaimer, the term of this patent is extended or adjusted under 35 U.S.C. 154(b) by 0 days.

(21) Appl. No.: 12/330,398

(22) Filed: Dec. 8, 2008

(51) Int. Cl.
*A63B 57/00* (2006.01)
*A63B 69/36* (2006.01)

(52) U.S. Cl. ..... 473/226; 473/238; 473/404

(58) Field of Classification Search ..... 473/240, 473/241, 404, 219, 226, 231, 238, 242; 33/333, 33/334, 365, 391, 1 H, 366.11–402
See application file for complete search history.

(56) References Cited

U.S. PATENT DOCUMENTS

| | | | | |
|---|---|---|---|---|
| 2,919,491 | A | 1/1960 | Darrell et al. | |
| 3,182,401 | A * | 5/1965 | Stevens | 33/228 |
| 3,242,582 | A | 3/1966 | Garrett | |
| 3,293,755 | A | 12/1966 | Cronwell | |
| 4,179,125 | A | 12/1979 | Cone et al. | |
| 4,843,725 | A | 7/1989 | Harris | |
| 4,934,706 | A | 6/1990 | Marshall | |
| 5,209,470 | A | 5/1993 | Cimaroli et al. | |
| 5,431,391 | A * | 7/1995 | Tracey | 473/257 |
| 5,755,623 | A | 5/1998 | Mizenko | |
| 5,792,015 | A | 8/1998 | Hoyt et al. | |
| 5,820,476 | A | 10/1998 | Amato | |
| 2003/0130069 | A1 * | 7/2003 | Baird | 473/404 |
| 2006/0073916 | A1 * | 4/2006 | Lin | 473/404 |

FOREIGN PATENT DOCUMENTS

| | | |
|---|---|---|
| GB | 2318980 | 5/1998 |

* cited by examiner

*Primary Examiner*—Sebastiano Passaniti
(74) *Attorney, Agent, or Firm*—Squire, Sanders & Dempsey L.L.P.

(57) ABSTRACT

A golf club incorporates a slope indicator on its shaft. to enable a golfer to estimate the slope of a putting green. When the golf club is placed on the ground, the slope indicator indicates a degree of slope. The golfer may engage a lock for the slope indicator. Engagement of the lock allows the golfer to lift the club off the ground to inspect the slope indicator.

14 Claims, 2 Drawing Sheets

GOLF CLUB WITH SLOPE INDICATOR

FIELD OF INVENTION

The present invention relates to golf clubs and in particular golf putters.

BACKGROUND

Many golfers have difficulty 'reading' a green so as to putt the golf ball to the pin with the correct speed and direction. In particular it may be difficult to assess the slope of the green, especially if the slope is slight or changes direction.

What is required is a simple means of determining green slope (if any) so as to allow a novice golfer to improve his game, and to learn to 'read' a green. Such a device would be particularly useful as a training aid.

There have been other attempts to provide a device for measuring the slope, such as a spirit level. Examples of golf clubs that use a spirit level are found in U.S. Pat. Nos. 5,755,623, 4,179,125, 5,209,470, 5,820,476, 2,919,491, and Great Britain Pat. No. 2318980, each of which are hereby incorporated by reference in their entirety for all purposes.

SUMMARY OF THE INVENTION

According to the invention there is a golf club that includes a scale for indicating the slope of a putting surface. The scale is preferably located on the shaft envelope, although it could be located along other areas of the golf club, such as a putter. The scale includes a weight balanced arm and a reference line. When the putter is placed on the putting surface, the arm moves relative to the reference line if there is a slope, i.e., inclination, to the putting surface. If there is no slope to the putting surface, then the arm does not move relative to the reference line.

The scale may include a cover, for example a slidable door or sleeve, to protect the face thereof from weather and dirt. A cover or sleeve may also be incorporated so that the club may be converted from training mode (scale exposed for use) and competition (sleeve slid over scale so that it cannot be used).

The scale may conveniently be incorporated within one component of the golf club, for example the handle, shaft or head, so as to facilitate manufacture and assembly.

BRIEF DESCRIPTION OF THE DRAWINGS

Other features of the invention will be apparent from the following description of a preferred embodiment shown by way of example only in the accompanying drawings in which:

FIG. 4A depicts a first, unlocked or free rotation position for the arm and FIG. 4B depicts a second, locked position for the arm.

DETAILED DESCRIPTION OF THE EMBODIMENTS

Figure 1:
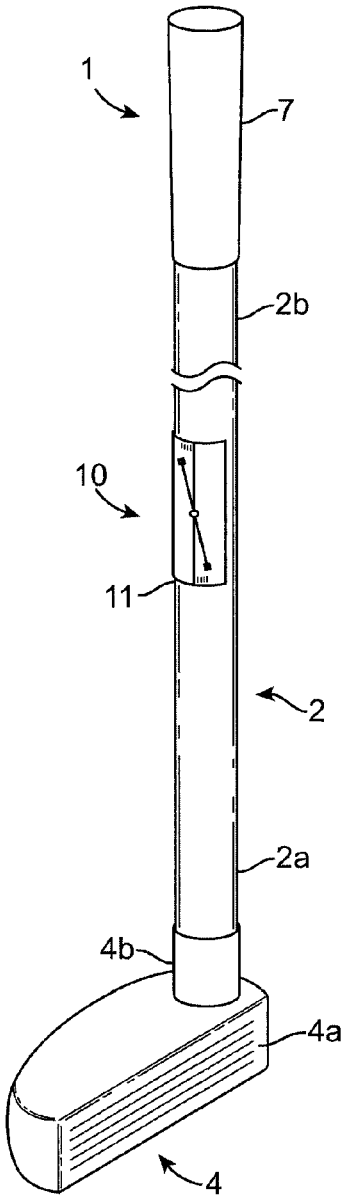
FIG. 1 is a perspective view of a putter having a scale disposed on its shaft.

Referring to FIG. 1, there is shown in perspective view a putter 1 with a scale 10 mounted to the putter shaft 2. The shaft 2 includes a lower end 2*a* that is connected to the putting head 4, e.g. via a hose 1. The upper end 2*b* of the shaft 2 receives a grip 7.

Figure 2:
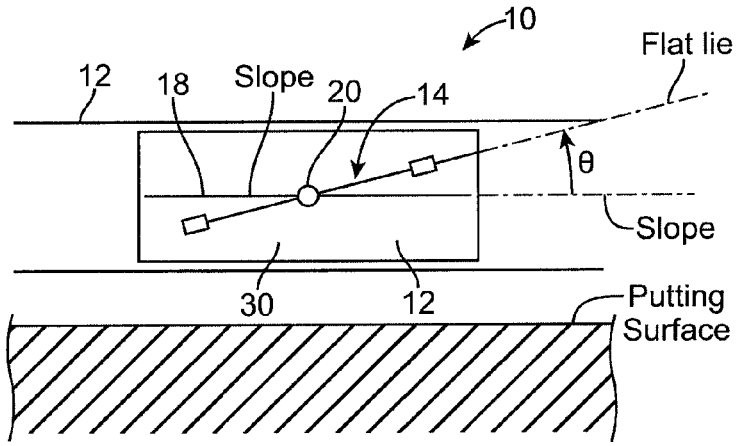
FIG. 2 is a side view showing a portion of the putter shaft and a close-up view of the scale of FIG. 1.
Figure 3A:
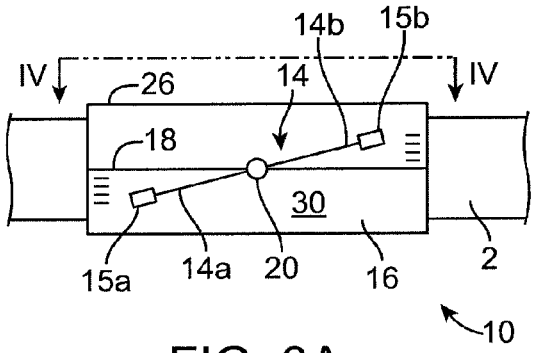
FIG. 3A is a side view close-up of the scale of FIG. 1.
Figure 3B:
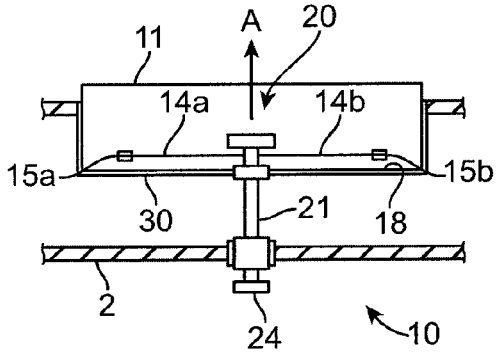
FIG. 3B is a top, cross-sectional view of the scale as taken from section IV-IV in FIG. 3B. The scale includes an arm balanced about a rotation axis and a reference line to indicate the degree of rotation of the arm about the rotation axis.

Referring to FIGS. 2-3, the scale 10 indicates the degree of slope to a green by utilizing a pair of weighted ends 15*a*, 15*b* of a balance arm 14 configured to freely rotated about a shaft assembly 30. The degree of movement of the arm 14 is appreciated by inspecting the deviation of the arm 14 relative to a fixed reference line 18 formed on the front surface of a backboard or reference surface 30. the scale 10 may be enclosed in a glass or plastic case 11. The case 11 may be formed as a diverging convex lens, which magnifies the relative positioning between the arm and reference line 18 for ease of viewing by the golfer.

When the putter 1 is placed on the putting surface in the manner shown in FIG. 2, i.e., with the reference line 18 extending parallel to the slope of the green and the rotation axis A (see FIG. 3B) orientated substantially perpendicular to the vertical, the arm 14 will rotate clockwise or counter clockwise if the slope of the putting surface is at an angle to the horizontal. The degree of slope may then be understood by the angle θ between the reference line 18 and the arm 14.

Regardless of the tilt or slope of the putter, the arm 14 will extend parallel to the horizontal when the arm 14 is balanced about its support point 20. Thus, in FIG. 2 the scale 10 indicates the degree of slope of the putting surface based on the difference between the horizontal (arm 14 orientation) and the slope of the green (reference line 18). The difference in degree of slope being indicated by the angle θ between line 14 and line 18. In some embodiments, this perturbation or rotation may be expressed visually to the golfer by simply inspecting the relative locations of the lines 14, 18, by using reference hash marks or reference lines displayed across the surface 30 or placed on the glass/plastic cover 11, or by using distinguishing colors or patterns (see FIGS. 6A-6B).

Figure 4A:
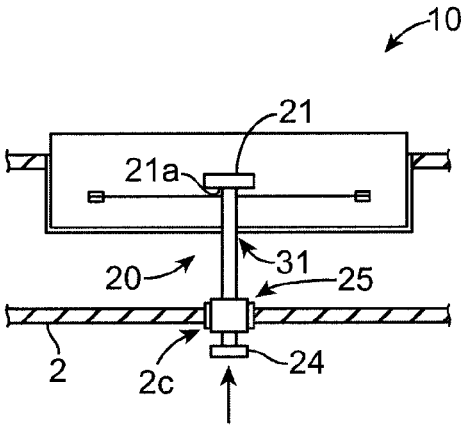
FIGS. 4A-4B are two top views of the scale as taken from section IV-IV in FIG. 3B.
Figure 4B:
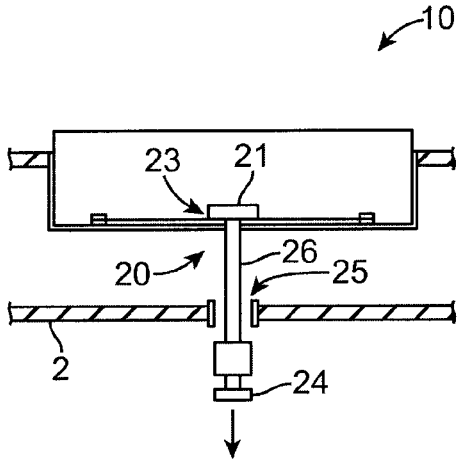
Figure 5:
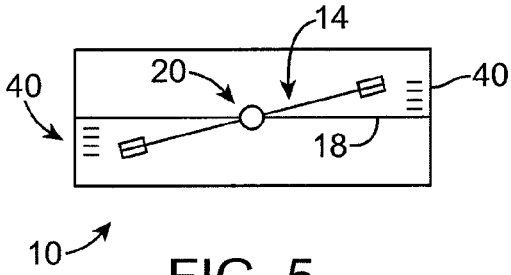
FIG. 5 shows a scale with hash marks.

According to another aspect of the disclosure, the scale 10 includes a locking feature that enables a golfer to pick up the putter to inspect the slope depicted on the scale 10. Referring to FIGS. 4A-4B, which shows a cross-sectional view of the scale 10 as in FIG. 3B, the scale includes a shaft 20 about which the arm 14 pivots. The shaft includes a head 21, a lower end having a knob 24 and a fitting 2*e* that allows shaft to be pulled and pushed up or down, as indicated in FIGS. 4A-4B. When the knob 24 is pushed upwards as shown in FIG. 4A, the head 21 is separated from the surface 30 and does not obstruct the rotation of the arm 14, so that the arm 14 can freely rotate about the shaft 20. When the head 21 is brought down to abut the surface 30, as indicated by reference 23 in FIG. 4B, the head 21 is pulled into abutment with the surface 30 and arm 14, thereby retraining free rotation of the arm 14. The knob 24 may be easily pressed towards the shaft opening 2*e*, or pulled away from the shaft opening 2*e* to selectively engage/disengage the head 21 from the arm 14 by known methods in the art, e.g., by having a resilient, plastic ledge that engages with a ridge formed on the shaft 26 that selectively positions the head 21 in the locked (FIG. 4B) or unlocked position (FIG. 4A). This locking feature enables a golfer to pick up the putter to inspect the slope indicated on the scale 10 without disrupting the relative position between the arm 14 and reference line 18.

In use, the golfer would first place the putter 1 on the ground in the manner shown in FIG. 2 (so that the rotation axis A is about perpendicular to the vertical) and allow the arm 14 to come to rest. Next, the golfer would pull the knob 24 out (FIG. 4B) so as to fix the arm 14 in its balance position relative to the reference line 18. The golfer may then pick up the putter to visually inspect the position of the arm 14 relative to the line 18. This locking feature can obviate the need for a golfer to have to bend down to an uncomfortable position in order to inspect the scale 10.

Figure 6A:
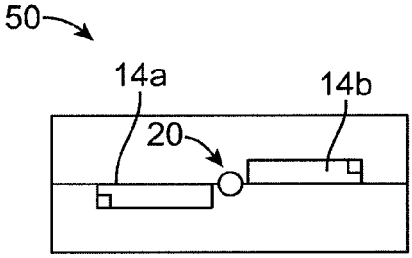
FIGS. 6A-6B shows an alternative embodiment of the scale. According to these embodiments, different colors are used to indicate whether there is a slope to the putting surface.
Figure 6B:
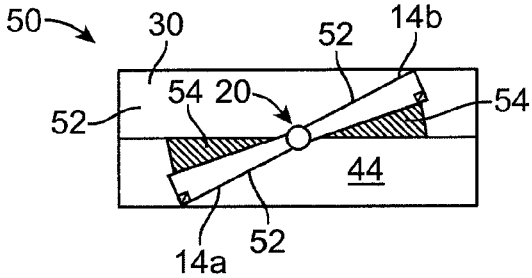

Referring to FIGS. 6A-6B, According to some embodiments, the scale 10 may include hash marks 40 that can be used to inspect the degree of slope, i.e., the amount that the arm 14 has rotated relative to the reference line 18. According to other embodiments, a scale 50 includes arms 14 which have a first color 52 and are shaped to cover a second color 54 when the putting surface is flat (FIG. 6A). When the putter 1 is placed on a sloped surface (FIG. 6B), the arm 14 having a first color 52 surface rotates to expose the second color 54. The first color 52 may be, for example, green and the second color 54 red.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What I claim is:

1. A golf club, comprising:

a shaft having a shaft axis; and a scale disposed on the shaft, the scale including:

an arm having a first end, a second end, and a medial portion between the first and second ends, a fixed reference indicia disposed adjacent the arm and extending approximately parallel to the shaft axis, and a pivot support defining a pivot point for the arm and supporting the arm at its medial portion such that the arm can freely rotate within a plane and about the pivot support, wherein the reference indicia extends through the pivot point and at least one of the first end and the second end when the golf club is placed on a zero-slope surface, and wherein when the golf club is placed on a sloped surface, the arm is adapted to displace by an angle relative to the shaft, the angle being proportional to the degree of slope of the surface; and a pivot lock for manually engaging the pivot support and arm, such that with the lock engaged the arm is fixed in rotation relative to the reference indicia and with the lock disengaged the arm is free to rotate relative to the reference indicia.

2. The golf club of claim 1, wherein the reference indicia is a line extending through the first and second ends and the pivot point.

3. The golf club of claim 2, the scale further including hash marks extending approximately orthogonally of the arm, fixed relative to the shaft and disposed adjacent one or both of the first and second ends, the hash marks being indicative of a plurality of magnitudes of angular displacements of the arm relative to the reference line when the golf club lays on a sloped surface.

4. The golf club of claim 1, wherein the scale is enclosed within an at least a partially transparent case and the reference indicia includes a first and second reference indicia, wherein when the golf club lies on a zero-slope surface the first indicia is viewable through the case while the second indicia is obstructed by the arm, and when the golf club lies on a sloped surface both the second and first indicia are viewable through the case.

5. The golf club of claim 4, wherein the first and second indicia are a first and second color, first and second pattern, and/or first and second material.

6. A golf club, comprising:

a shaft having a shaft axis; and a scale disposed on the shaft, the scale including:

an arm having a first end, a second end, and a medial portion between the first and second ends, a fixed reference indicia disposed adjacent the arm and extending approximately parallel to the shaft axis, and a pivot support defining a pivot point for the arm and supporting the arm at its medial portion such that the arm can freely rotate within a plane and about the pivot support, wherein the reference indicia extends through the pivot point and at least one of the first end and the second end when the golf club is placed on a zero-slope surface, and wherein when the golf club is placed on a sloped surface, the arm is adapted to displace by an angle relative to the shaft, the angle being proportional to the degree of slope of the surface; and wherein the pivot support further includes a first configuration in which the arm can freely rotate within a plane and about the pivot support, and a second configuration in which the arm cannot rotate within the plane;

the golf club further including a means for locking the pivot, comprising a stem received in a hole of the shaft, the stem having, at one end, the pivot support and at the opposite end a knob, wherein when the knob is pulled away from the shaft hole, the pivot support is configured in a locked position, preventing the arm from rotating within the plane, and when the knob is pushed towards the hole the arm can freely rotate within a plane and about the pivot support.

7. The golf club of claim 6, wherein the pivot locking means includes an abutting surface fixed relative to the club shaft and adjacent the stem, wherein when the knob is pulled away from the shaft hole, the arm is pulled towards the abutting surface and when the arm is in contact with the abutting surface, friction holds the arm in place, thereby preventing rotation within the plane the knob is pushed towards the hole.

8. The golf club of claim 7, further including a transparent glass or plastic case enclosing the scale, and an opening in the golf club shaft which receives the case, the case including a convex lens.

9. The golf club of claim 6, wherein the reference indicia is a line extending through the first and second ends and the pivot point.

10. The golf club of claim 9, the scale further including hash marks extending approximately orthogonally of the arm, fixed relative to the shaft and disposed adjacent one or both of the first and second ends, the hash marks being indicative of a plurality of magnitudes of angular displacements of the arm relative to the reference line when the golf club lays on a sloped surface.

11. The golf club of claim 6, wherein the scale is enclosed within an at least a partially transparent case and the reference indicia includes a first and second reference indicia, wherein when the golf club lies on a zero-slope surface the first indicia is viewable through the case while the second indicia is obstructed by the arm, and when the golf club lies on a sloped surface both the second and first indicia are viewable through the case.

12. The golf club of claim 11, wherein the first and second indicia are a first and second color, first and second pattern, and/or first and second material.

13. A method for measuring a slope of a putting surface, comprising the steps of providing a golf club having a scale disposed on the shaft, the scale including an arm having a first end, a second end, and a medial portion between the first and second ends, a fixed reference indicia disposed adjacent the arm and extending approximately parallel to the shaft axis, a pivot support defining a pivot point for the arm and supporting the arm at its medial portion such that the arm can freely rotate within a plane and about the pivot support, and a pivot lock, wherein the reference indicia extends through the pivot point and at least one of the first end and the second end when the golf club is placed on a zero-slope surface, and wherein when the golf club is placed on a sloped surface, the arm is adapted to displace by an angle relative to the shaft, the angle being proportional to the degree of slope of the surface;

placing the club on a sloped putting surface;

engaging the pivot lock, thereby locking the arm position relative to the reference indicia;

lifting the club from the putting surface after the pivot lock has been engaged; and inspecting the slope of the sloped putting surface by inspecting the arm position relative to the reference indicia.

14. A method for measuring a slope of a putting surface, comprising the steps of providing a golf club having a scale disposed on the shaft, the scale including an arm that freely moves between a first and second indicia disposed on the golf club when a pivot lock is disengaged, and fixes the arm's position relative to the first and second indicia when the lock is engaged;

placing the club on a sloped putting surface with the pivot lock disengaged;

engaging the pivot lock;

lifting the club from the putting surface after the pivot lock has been engaged; and inspecting the slope of the sloped putting surface by inspecting the arm position relative to the first and second reference indicia.

* * * * *